US005297371A

United States Patent [19]

Borghetto

[11] Patent Number: 5,297,371

[45] Date of Patent: Mar. 29, 1994

[54] JOINT FRAMEWORK FOR BUILDING UNITS

[76] Inventor: Oddo Borghetto, Via Giotto 19, 31033 Castelfranco-Veneto, Italy

[21] Appl. No.: 16,877

[22] Filed: Feb. 11, 1993

Related U.S. Application Data

[63] Continuation of Ser. No. 755,582, Aug. 26, 1991, abandoned, which is a continuation of Ser. No. 532,182, Jun. 1, 1990, abandoned, which is a continuation of Ser. No. 403,837, Sep. 1, 1989, abandoned, which is a continuation of Ser. No. 191,211, May 6, 1988, abandoned.

[51] Int. Cl.[5] ..... E04C 1/42

[52] U.S. Cl. ..... 52/308; 52/200

[58] Field of Search ..... 52/200, 308, 582, 588, 52/595; 49/483.1, DIG. 1, DIG. 2

[56] References Cited

U.S. PATENT DOCUMENTS

| | | | |
|---|---|---|---|
| 2,419,267 | 4/1947 | Lenke | 52/308 |
| 3,012,378 | 12/1961 | Boyd | 52/308 |
| 3,749,908 | 7/1973 | Esser et al. | 52/200 X |
| 4,570,393 | 2/1986 | Minter | 52/200 X |
| 4,796,400 | 1/1989 | Mulder | 52/200 |

FOREIGN PATENT DOCUMENTS

| | | | |
|---|---|---|---|
| 545931 | 3/1956 | Belgium | 52/308 |
| 1092631 | 11/1960 | Fed. Rep. of Germany | 52/308 |
| 623209 | 7/1961 | Italy | 52/308 |
| 677804 | 8/1952 | United Kingdom | 52/308 |

*Primary Examiner*—Carl D. Friedman
*Assistant Examiner*—Kien Nguyen
*Attorney, Agent, or Firm*—Kinney & Lange

[57] ABSTRACT

In a joint formwork for glass building units, which consist of a plurality of glass units, in particular glass blocks, which are connected by reinforced mortar or concrete joints which are covered on at least one side by outer frames which enclose the glass units, according to the invention it is provided that each outer frame forms a building unit and the cover strips of its angularly rigidly interconnected frame members are individually positively connected on their rear side to neighboring frame members of adjoining outer frames by moulded-on, projecting tongues and covered edge strips, the edge strip on each frame member being recessed for the guidance of at least one tongue of the neighboring frame member and having for the frame recess of the other frame member a substantially smooth tongue and at least one further tongue, which bears on its upper side a groove, which establishes the positive connection to the edge strip.

11 Claims, 12 Drawing Sheets

JOINT FRAMEWORK FOR BUILDING UNITS

This is a continuation of U.S. Ser. No. 07/755,582 filed on Aug. 26, 1991 (now abandoned) which is a continuation of U.S. Ser. No. 07/532,182 filed on Jun. 1, 1990 (now abandoned) which is a continuation of U.S. Ser. No. 07/403,837 filed on Sep. 1, 1989 (now abandoned) which is a continuation of U.S. Ser. No. 07/191,211 filed on May 6, 1988 (now abandoned).

BACKGROUND OF THE INVENTION

The invention relates to a joint framework for glass building units, which consist of a plurality of glass units, in particular glass blocks.

Glass building units according to the invention are generally glass plates which differ from simple panes of glass by the profiling of their edge, it being possible for at least one of the major faces of the glass unit to be profiled for its part. Glass blocks generally combine two such glass units which are mutually offset and connected by their rear sides.

Glass building units according to the invention are generally prefabricated compound units which are built into one or more space limitations of a building. They are preferably floor units, which due to their construction from glass units, allow the incidence of light and, due to their reinforced mortar or concrete joints, absorb their own weight and transfer it to structures of the building. Such glass building units are generally fabricated horizontally, by laying out the glass units apart from one another by the joint spacing, introducing the joint reinforcement into the joint spaces and then filling the joints with mortar or concrete. The underlying joint surfaces in fabrication must be encased. This produces joint faces as smooth as the framework, which is of significance in particular on the visible side of the glass building unit.

For glass building units which are used in the vertical building confinements, that is in walls or internal dividing walls, a joint framework is known on which the invention is based. In this case, the glass units are bricked in situ, i.e., the glass building unit is built up from bottom to top. The joint framework consists of continuous profiles, which are used for the horizontal wall joints, and of profile sections, with which the vertical joints are encased. The profile sections are connected to the horizontal joint limitations, producing outer frames on both sides of the glass building unit, which enclose the glass units and mask the joint faces.

While the joint framework according to the invention is a type of permanent framework, hitherto repeatedly reusable frameworks have generally been used for the horizontal fabrication of glass building units. These consist of a matrix in the form of a mat-shaped mould, in the recesses of which the glass units are laid before the joints are cast following introduction of the reinforcement. The glass building units thus fabricated do not have any outer frames but joint faces as smooth as the framework. This frequently requires different mortars in the joints in order to bring about the necessary strength on the one hand and the sealing of the joint on the other hand, because the joint mortar or concrete interacting with the reinforcement is generally not watertight. Consequently, fabrication of the units is hampered not inconsiderably. It is also difficult to obtain in this way joints which, for reasons of strength, must have relatively large dimensions to the plane of the glass building unit. This applies in particular to glass building units of considerable dimensions which are exposed to stresses transversely to their principal plane. For example, load-bearing floor units which are made as glass building units must, due to the considerable weight of the glass units and the resultant stresses, be made with joints which project to one side beyond the glass units, which later in the building is usually the inside.

SUMMARY OF THE INVENTION

The invention is based on the object of creating a joint framework of the type assumed as known which makes possible glass building units from the glass units described at the beginning and which simplifies the fabrication of the glass building units.

The invention achieves this object by the features of patent claim 1. Further features of the invention are the subject of the subclaims.

The joint framework according to the invention is made up of outer frames which are in each case assigned to a glass unit in such a way that they positively fix the glass unit. This happens with the outer frame members which, due to their integral design, have the necessary strength and angular rigidity. The frames can be positively interconnected in such a way that a matrix of them can be built up, by which the joint dimensions are fixed. The fastening of the outer frames to one another necessary for this and their mutual alignment are ensured by the interaction of the tongues with the edge strips. In this arrangement, the tongues interacting with recesses of the edge strips are used for the correct orientation of the outer frames. The positive interlock takes place by the edge strips and the tongue grooves.

The wall units can be produced from a material which is more resistant than mat, in particular of unplasticized polyvinyl chloride (PVC) and thereby ensure the necessary strength even in the case of heavy glass building units, in particular glass blocks and thick joints with considerable quantities of mortar or concrete, as well as heavy reinforcements. In particular, the dimensions of the glass building units are immaterial, so that even such units having considerable surface dimensions can be fabricated. The outer frames completely cover the joint faces on the side concerned. As a result, the joints are at once watertight. Due to the flat design for shaping the joint faces, these walled units can be laid out on a level surface, but also on a curved surface, and positively interconnected. This makes it possible to fabricate the glass building units horizontally and make them flat or convex.

The invention is preferably implemented with the features of FIGS. 3–7. Due to the inwardly projecting arrangement of sloped sides of the outer frame in conjunction with their frustoconical shape, there is produced on one side of the glass building unit, which is underneath in horizontal fabrication, a projecting joint arrangement which makes it possible to increase the joint dimensions with respect to the thickness of the glass unit and thereby bring about the necessary strength of the glass building unit.

In order to be able to fix the glass building unit in the outer frame in cases of such increased joint dimensions, implementation of the features as shown in FIGS. 4–5 is recommended. The retainer used for this supports the glass unit in horizontal fabrication, but at the same time also fixes it positively in all directions. This fixing takes place with the enclosing strip, while at the same time the building unit is supported. Generally, the result is a comparatively simple fabrication of the outer frames, which can be produced with preference by the injection-moulding process.

In the case of the embodiment according to FIGS. 4–5, the retainer of the outer frame is separate and forms a frame on its own. In particular, this allows the use of extension frames for increasing the joint depth in accordance FIGS. 5A–5C. The extension frames are profiled in such a way that several of them can also be used together FIGS. 7A–7B.

The joint depth can, in addition, be changed by the choice of the height of the sloped sides of the base.

BRIEF DESCRIPTION OF THE DRAWINGS

Exemplary embodiments of the invention are described below and explained with reference to the drawings, in which:

FIG. 9 are sequential partial cross sectional views along lines 9—9 of FIG. 8 through the parts thereby interacting with one another.

DETAILED DESCRIPTION OF THE PREFERRED EMBODIMENTS

The glass building unit (1) is fabricated horizontally on a level surface (2). It consists of a plurality of glass units (3), which are interconnected by means of continuous longitudinal joints, of which some are shown at (4–6), and continuous transverse joints, of which some are designated by (7–9). The longitudinal joints (4–6) and the transverse joints (7–9) form a joint framework (100), FIG. 10. The joints (4–9) are encased, the joint framework (100) being lost as a whole, i.e. permanently incorporated in the glass building unit (1).

Figure 1:
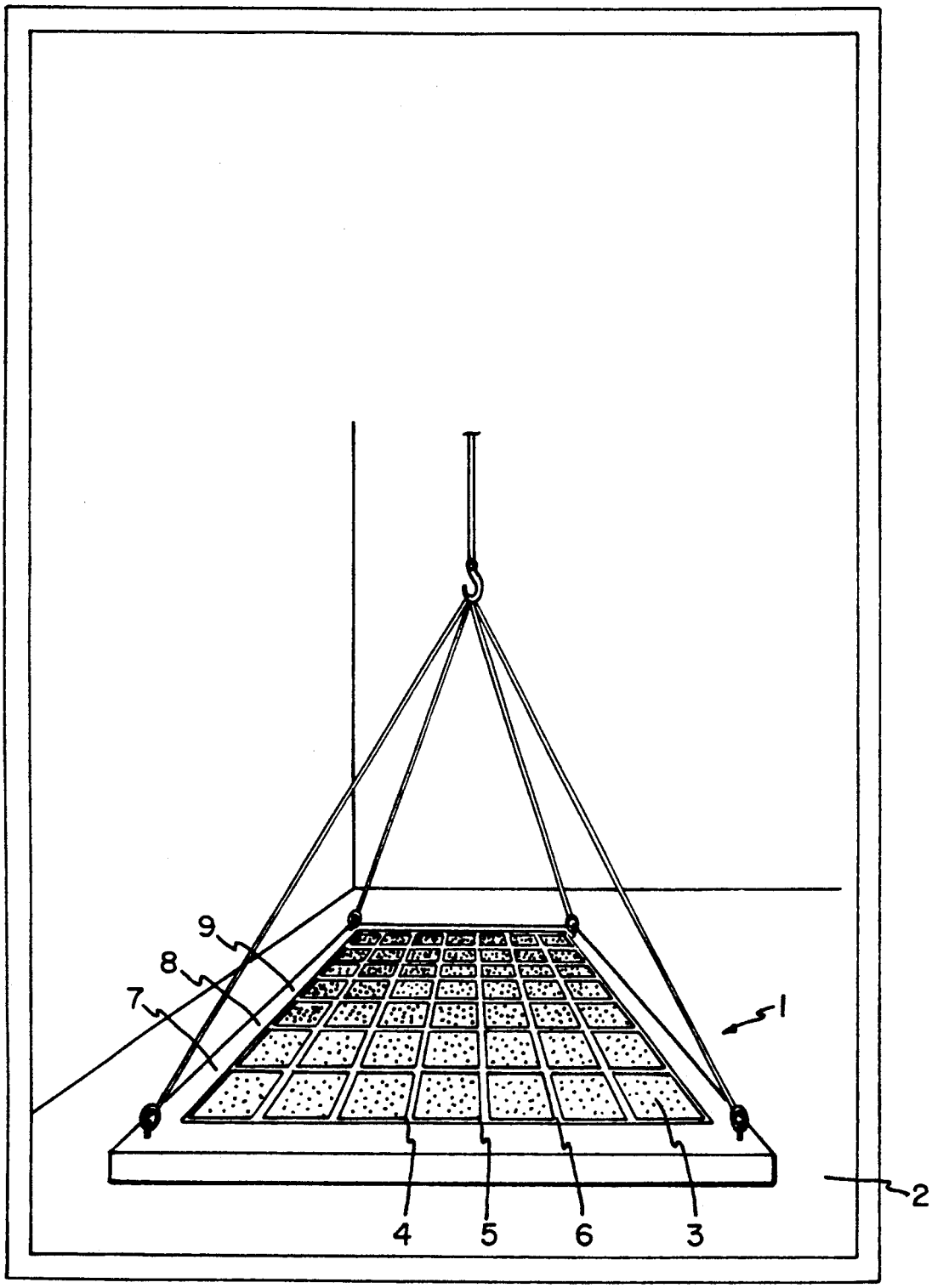
FIG. 1 shows a glass building unit according to the invention after its horizontal fabrication.
Figure 2:
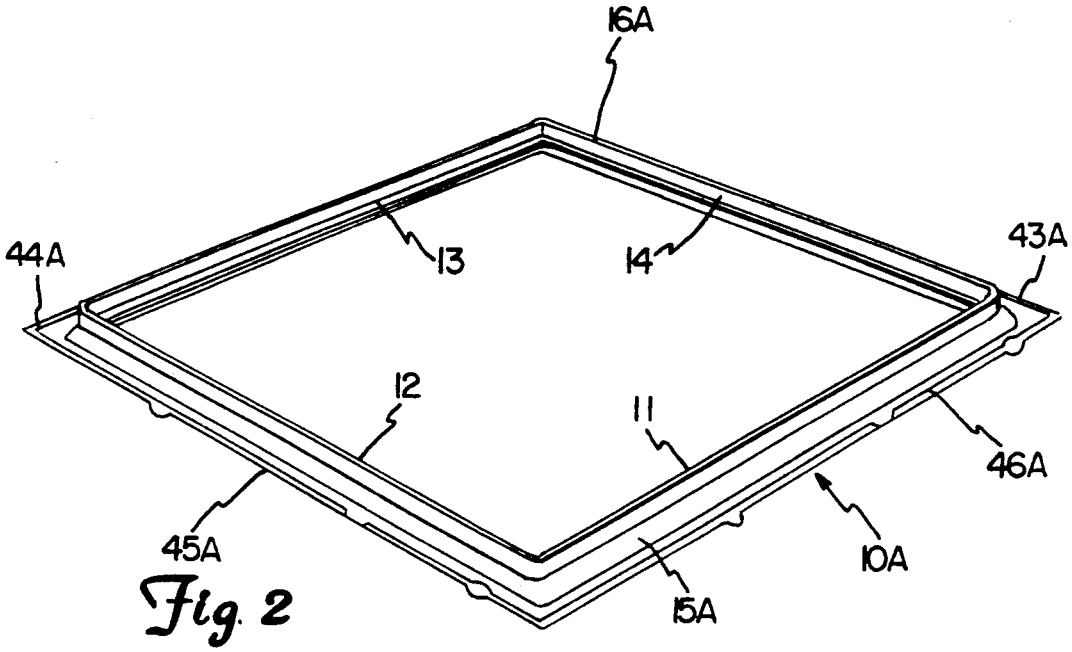
FIG. 2 shows, in perspective representation, a first embodiment of an outer frame according to the invention.
Figure 3:
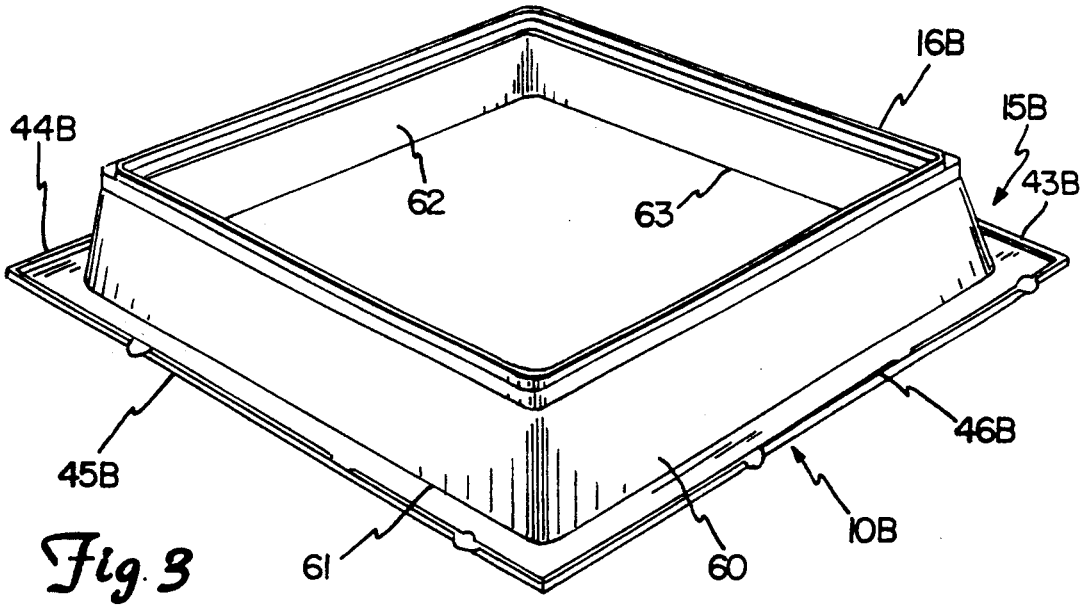
FIG. 3 shows an outer frame according to the invention in a modified embodiment.
Figure 10:
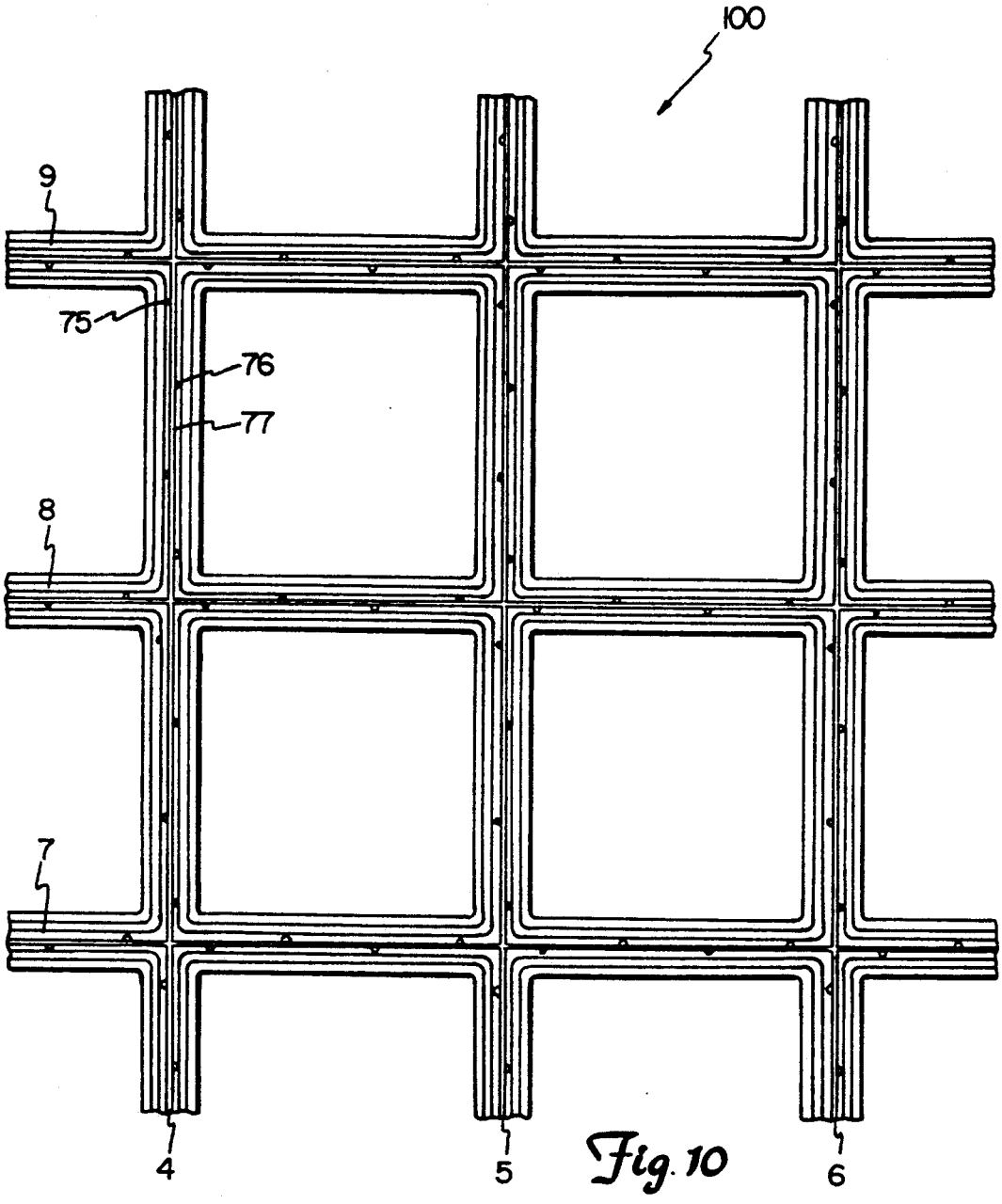
FIG. 10 shows on a reduced scale a plan view of the joint framework according to FIG. 8.

The joint framework (100) FIG. 10 consists of a plurality of outer frames, as are reproduced for example in FIGS. 2 and 3. The outer frame (10A) according to FIG. 2 consists of the angularly rigidly interconnected four frame members (11–14). The four interconnected frame members (11–14) of the frame (10A) include a retainer portion (16A), an truncated pyramid base (15A) and cover strips or ledges (43A–46A). The frame (10A) consists of one piece to define a rigid construction.

The outer frame (10B) according to FIG. 3 is similarly formed to frame (10A) and includes a retainer portion (16B), a truncated pyramid base (15B) and cover strips or ledges (43B–46B). However frame 10B (FIG. 3) differs from the outer frame (10A) according to FIG. 2 inter alia by its increased height. In particular, sloped sides (60, 61, 62 and 63) form the truncated pyramid base (15B) and are of increased height. As a result of the increased dimensions of the sloped sides (60, 61, 62 and 63), the truncated pyramid base (15B) has increased height. Another difference arises from the shaping of its retainer portion (16B), which is formed by a peripheral profile and serves for the positive fixing of the glass unit (3) (not shown in FIG. 3). The retainer portion (16A and 18B), truncated pyramid base (15A and 15B) and cover strips or ledges (43A–46A and 43B–46B) in the embodiments according to FIGS. 2 and 3 are integrally designed.

Figures 4A, 4B:
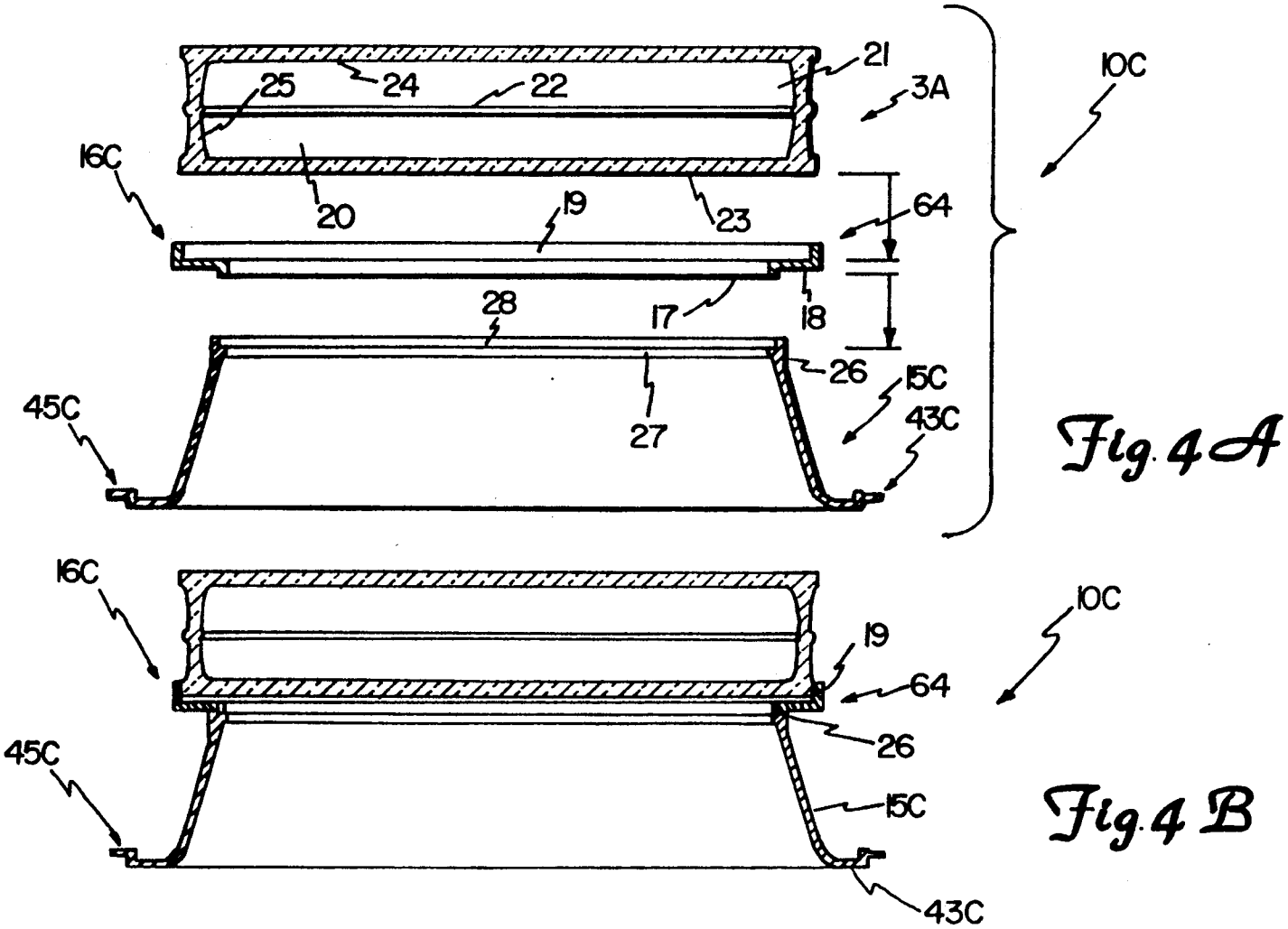
FIG. 4A shows an exploded representation of an outer frame and of a retaining unit according to the invention for a glass block, represented in cross-section.
FIG. 4B shows a representation of the assembled parts of FIG. 4A, the formwork and the glass unit in each case being represented in cross-section.

FIGS. 4A & 4B illustrates another embodiments of a frame (10C). According to the representation of FIGS. 4A and 4B, frame 10C includes a retainer portion (16C) for fixing glass unit (3A) (similar to 16A and 16B of FIGS. 2 and 3, respectively), a truncated pyramid base (15C) (similar to the truncated pyramid sections 15A and 15B of FIGS. 2 and 3), and cover strips or ledges (43C–46C, not all visible). The retainer portion (16C) is made as a separate retaining unit (64) and has a cross-sectionally Z-shaped profile. The Z-shaped profile consists of an inner strip or flange (17), which projects to one side of a profile flange (18) into the truncated pyramid base (15C) and of an outer rib (19), which encloses the glass unit (3A). The glass unit (3A) consists of two halves (20, 21), which are placed together and interconnected at a joint (22). This is a typical glass unit (3A), the major surfaces of which are formed by panes (23, 24) and are designed integrally with peripheral webs (25).

In the case of the embodiment according to FIGS. 4A and 4B, the retaining unit (64) can be placed on the inner edge (26) of the truncated pyramid base (15C), in which the inner strip or flange (17) is positively fitted, the profile flange (18) being supported by the truncated pyramid base (15C) on the peripheral ledge (27). The glass unit (3A) is supported by the edge of its pane (23) on the flange (18), the rib (19) positively fixing the glass unit (3A).

Figure 5A:
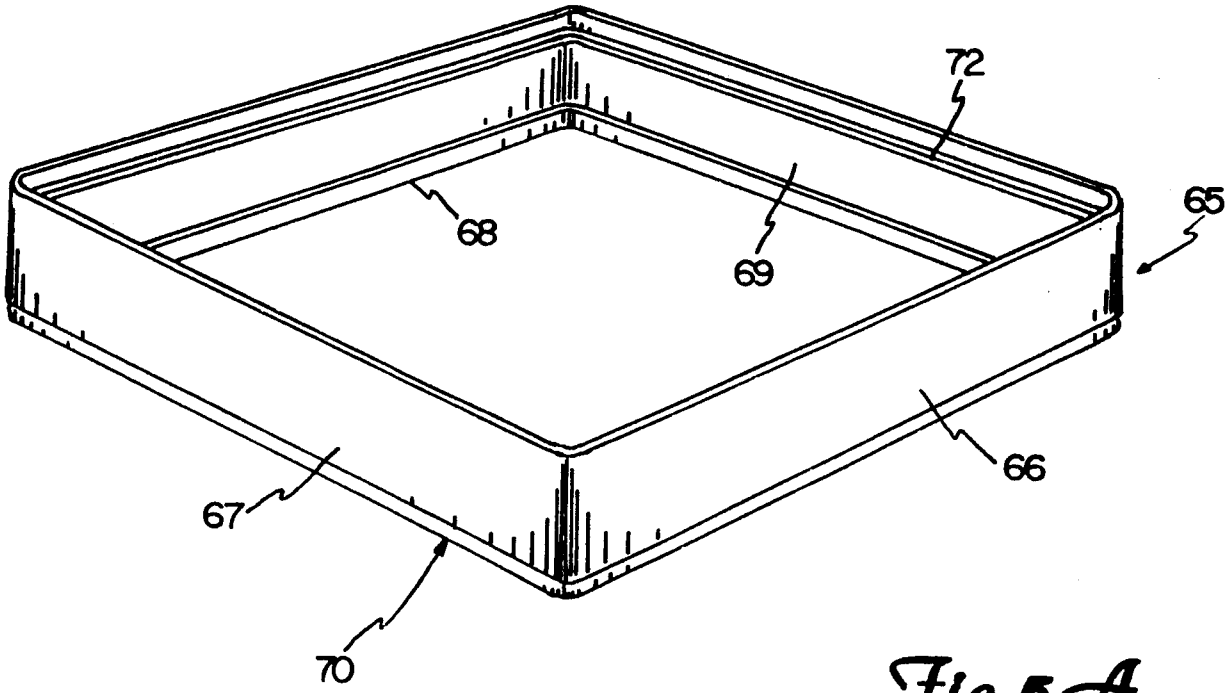
FIG. 5A shows an extension frame in a representation according to FIGS. 2 and 3.
Figure 5B:
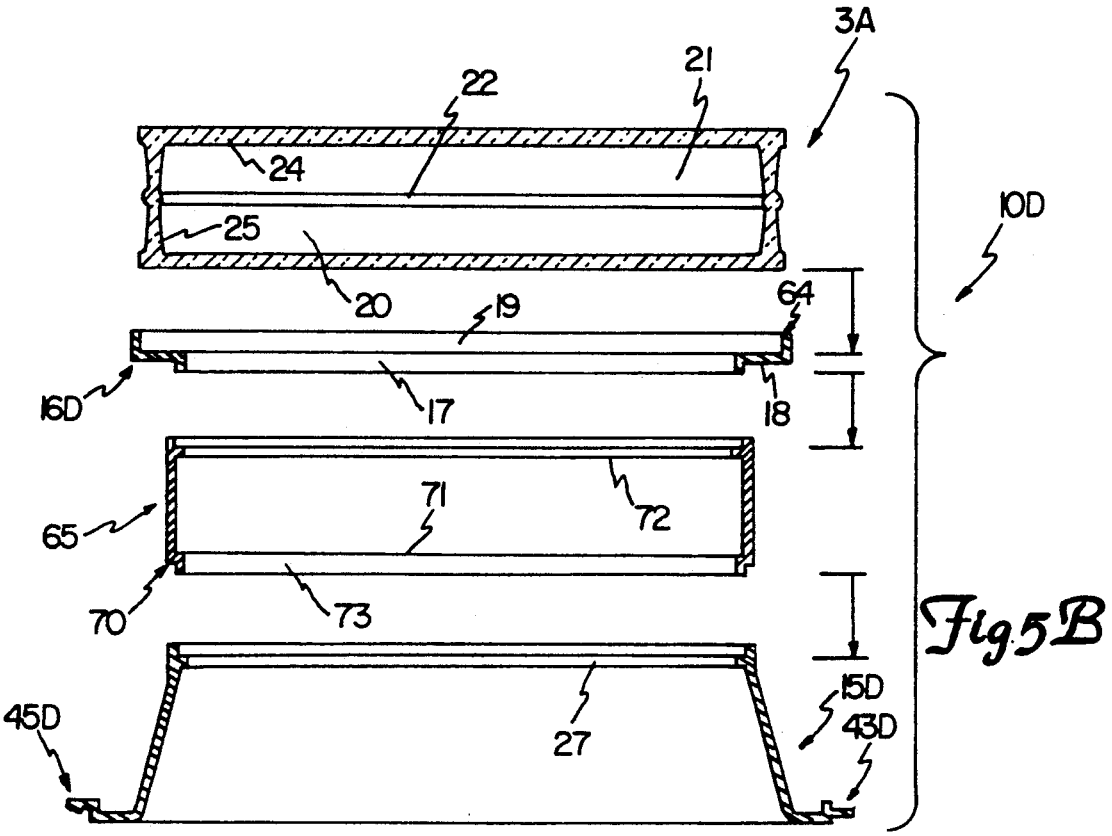
FIG. 5B shows an embodiment of the framework, in exploded representation, according to the invention with the retaining unit and extension frame in the design according to FIGS. 4A and 4B.
Figure 5C:
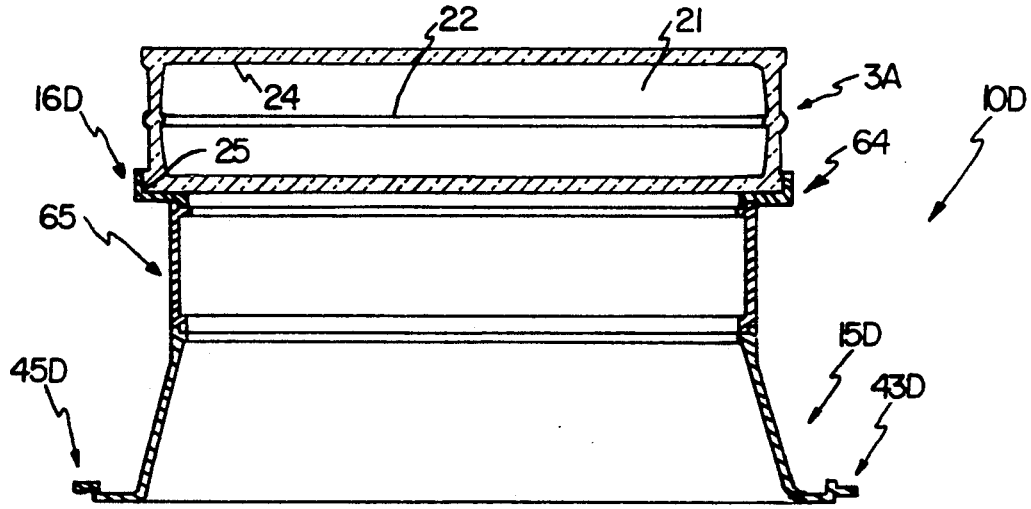
FIG. 5C shows a representation of the assembled parts of FIG. 5B.

FIGS. 5B and 5C show a frame (10D) similar to (10C) shown in FIGS. 4A and 4B including an extension frame (65) as shown in FIG. 5A which allows the frame depth to be increased. Frame (10D) includes a retainer portion (16D), a truncated pyramid base (15D) and cover strips or ledges (43D–46D, not all visible) frame (17C). The retainer portion (16D) is formed of a separate retaining unit (64). FIG. 5A shows, in perspective representation, the extension frame (65), with which the frame depth can be increased. As shown in FIG. 5A, the extension frame (65) includes four rigidly connected sides (66, 67, 68 and 69). Sides (66–69) of the extension frame (65) bear on their insides a peripheral ledge (72), which is also used to support the inner strip or flange (17) of the retaining unit (64). Thus, the retaining unit (64) with its inner strip or flange (17) is inserted in the extension frame (65), in which the inner strip or flange (17) is supported on the ledge (72). The glass unit (3A) can then be inserted into the retainer portion (16D), as described in conjunction with FIGS. 4A and 4B, but the extension frame (65) increases the depth of the joint. The extension frame (65) includes a peripheral indentation (70) on a face edge of the extension frame (65) opposite the ledge (72). In this arrangement, the peripheral indentation (70) serves for support on the ledge (27) of the truncated pyramid base (15C) and a peripheral strip (73), perpendicular thereto, serves for fixing extension frame (65) for supporting in the plane of the frame.

Figures 6A, 6B:
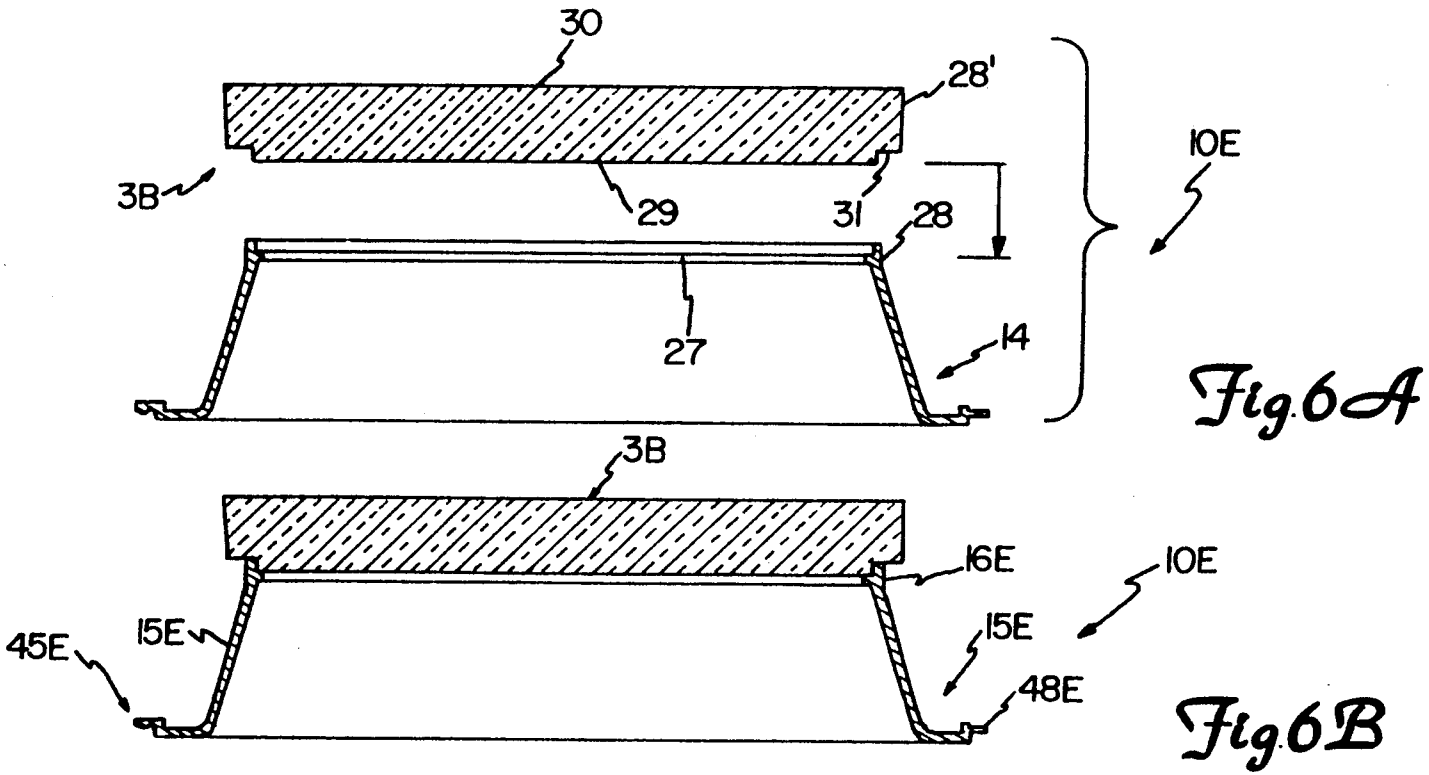
FIG. 6A shows an exploded representation of an outer frame and of a retaining frame according to the invention, represented in cross-section, for a modified glass unit.
FIG. 6B shows a representation of the assembled parts of FIG. 6A.

FIGS. 6A and 6B, illustrates another embodiment of frame (10E) for a flat glass unit (3B). In this case, frame (10E) has, as in the embodiment according to FIGS. 4A and 4B, a retainer portion (16E), a truncated pyramid base (15E) and cover strips or ledges (43E–46E, not all visible), which is designed in one piece. The profile of frame (10E), which is made up of the ledge (27) and the flange (28), cooperates with a corresponding flange (28') of a glass unit (3B). That is, the glass unit (3B) is formed with flat limiting surfaces (29, 30), and has a profiled edge, which is of angled design, to form recess (31) and flange (28'). The flange (28) can be inserted into the recess (31), the ledge (27) supporting the adjoining edge of the inner page (29).

Figure 7A:
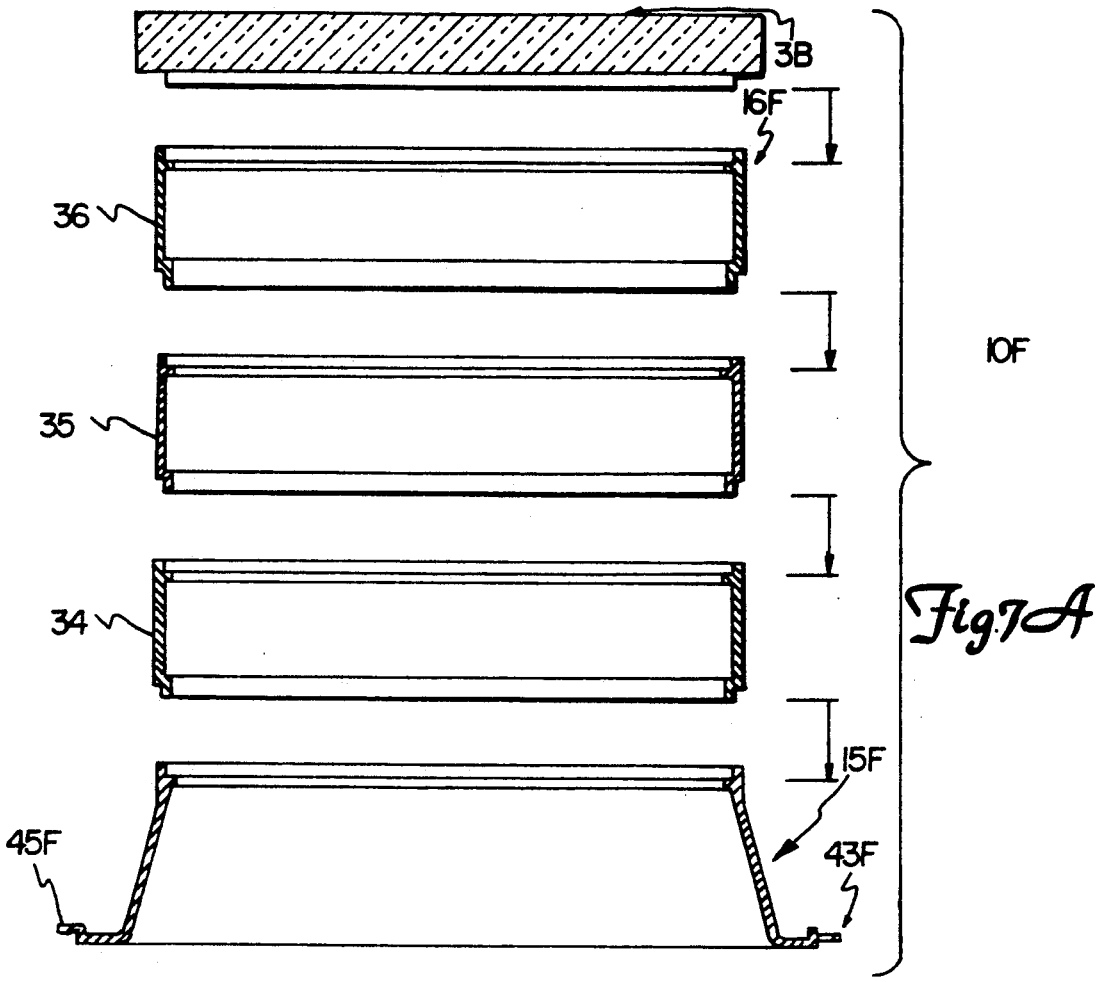
FIG. 7A shows, in a representation corresponding to FIG. 6A, a joint framework with a plurality of extension frames.
Figure 7B:
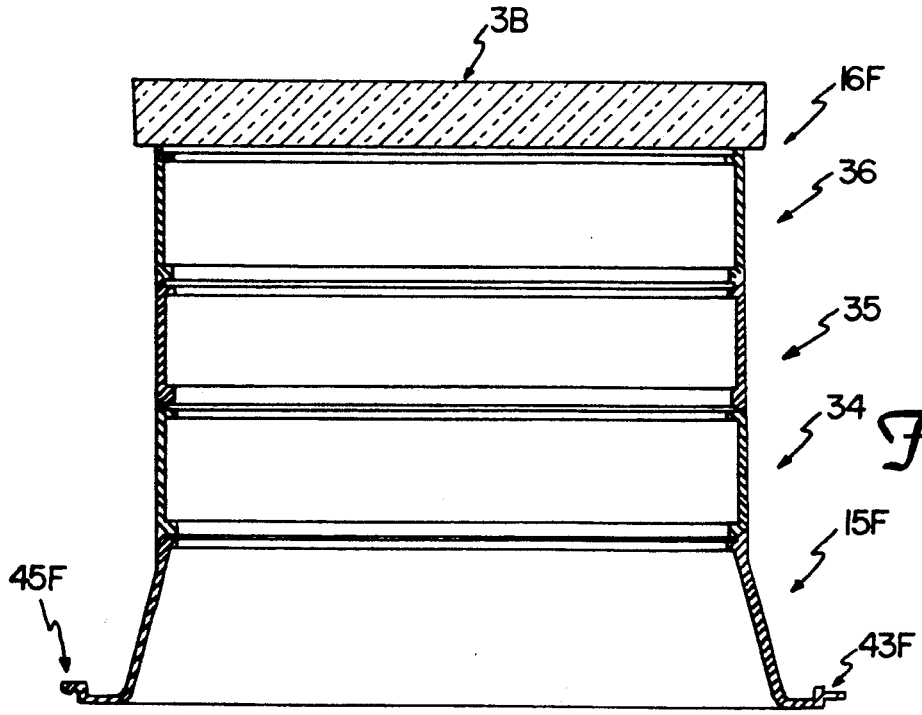
FIG. 7B shows a representation of the assembled parts of FIG. 7A.

FIGS. 7A and 7B illustrate frame 10F having a retaining portion (16F), a truncated pyramid section (15F) and cover strips or ledges (43F–46F). In the case of the embodiment of frame (10F) according to FIGS. 7A and 7B, the truncated pyramid base (15F) is combined with a plurality of extension frames (34–36), which are placed one on top of the other, as a result of which the joint depth can be increased virtually unlimitedly transversely to the building unit.

Figure 8:
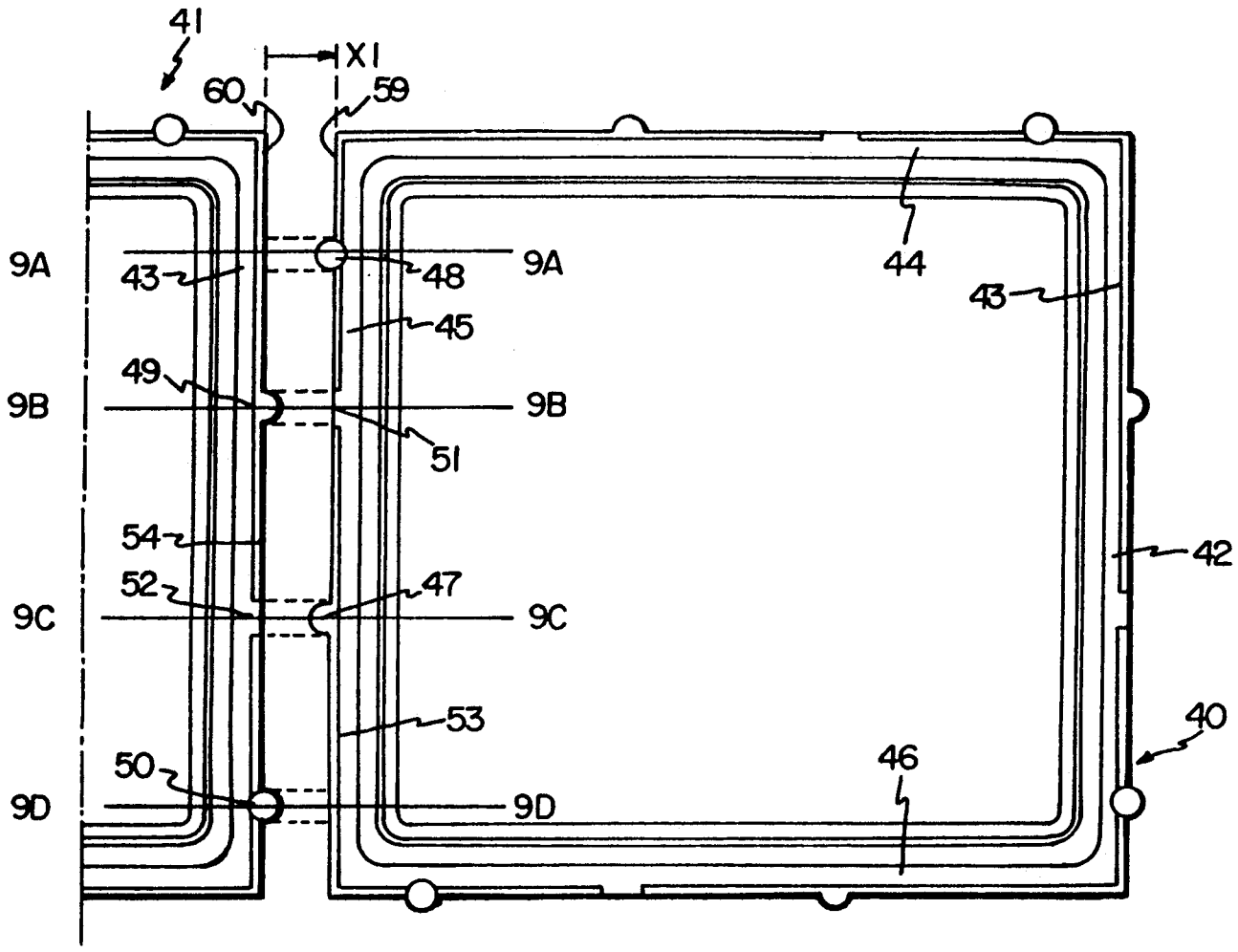
FIG. 8 shows the connection of the outer frames according to the invention in plan view.
Figure 9A:
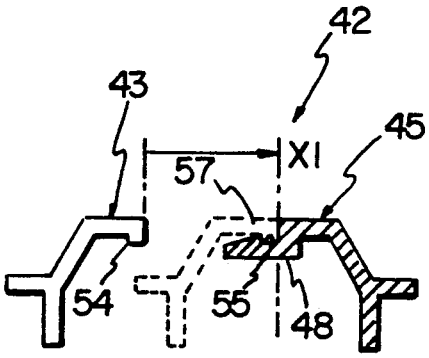
FIG. 9A is a cross sectional view along line 9A—9A of FIG. 8 through the parts thereby interacting with one another.
Figure 9B:
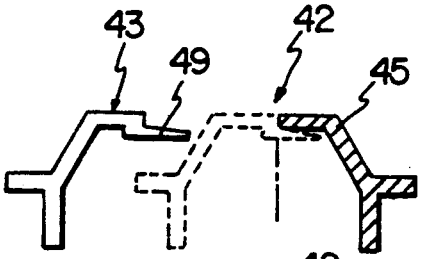
FIG. 9B is a cross sectional view along line 9B—9B of FIG. 8 through the parts thereby interacting with one another.
Figure 9C:
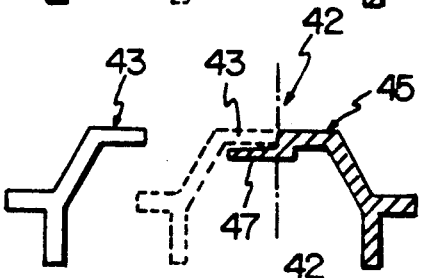
FIG. 9C is a cross sectional view along line 9C—9C of FIG. 8 through the parts thereby interacting with one another.
Figure 9D:
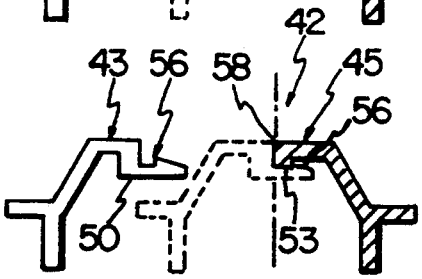
FIG. 9D is a cross sectional view along line 9D—9D of FIG. 8 through the parts thereby interacting with one another.
Figure 11:
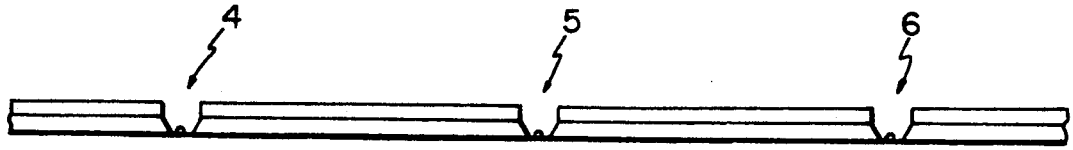
FIG. 11 is a view of the joint framework of FIG. 10 taken along line 11—11.

A plurality of outer frames of the different embodiment shown in FIGS. (2–7) can be combined in the way evident in particular from FIG. 8 into a framework (100) for the glass building unit (1). The frames are connected along cover strips or ledges (43–46) as illustration in FIGS. 10 and 11.

For example, consecutive frames (40 and 41) shown in FIG. 8 are connected along the cover strips or ledges (43–46). The cover strips (43–46) include on the rear side (42) moulded-on, projecting tongues (47, 48, and 49, 50 respectively), which are denoted only for the neighbouring cover strips (43 and 45) of frames (40 and 41). The tongues (47, 49) are smooth tongues. The smooth tongues (47, 49) extend into recesses (51, 52) in the neighboring cover strips, which recesses are made in rearwardly projecting edge strips (53, 54). As shown in FIG. 9, the tongue (49) can therefore be pushed onto the rear side (42) of the cover strip (45), the edges of the recess (51) guiding the edges of the tongue. Similarly, the tongue (47) can be pushed onto the rear side (42) of the cover strip (43), the edges of the recess (52) taking over the guidance.

The tongues (48, 50) have, on the other hand, a groove (55, 56) (FIG. 9), into which sections (57, 58) of the edge strips (53 and 54) assigned to the tongues engage during the pushing-together of the frames (40, 41). The guidance in the recesses (51, 52) produces a positive interlock in the plane of the drawing from top to bottom. The grooves (55, 56) and sections (57, 58) of the edge strips (53, 54) on the other hand have the effect of achieving a positive interlock in a plane perpendicular thereto. Since the tongues are on the rear side (42) of the cover strips (43, 45), the longitudinal edges (59, 60) of the cover strips (43, 45) can be butted against each other. Therefore, the face edges of the unit joints can be completely masked by the cover strips.

FIGS. 10–13 show, the course of the joints (4–6 to 7–9) forming the framework (100) and inserted vertical reinforcing bars (75, 76), which are in each case fastened alternatively at the horizontal reinforcing bars (77) running in the plane of the unit. These reinforcing bars are only provided singly according to FIG. 12 for relatively small joint heights. According to FIG. 13, however, their number is doubled, the reinforcing bars (78, 79) arranged one above the other being held by the vertical reinforcing bars (75).

Figure 14:
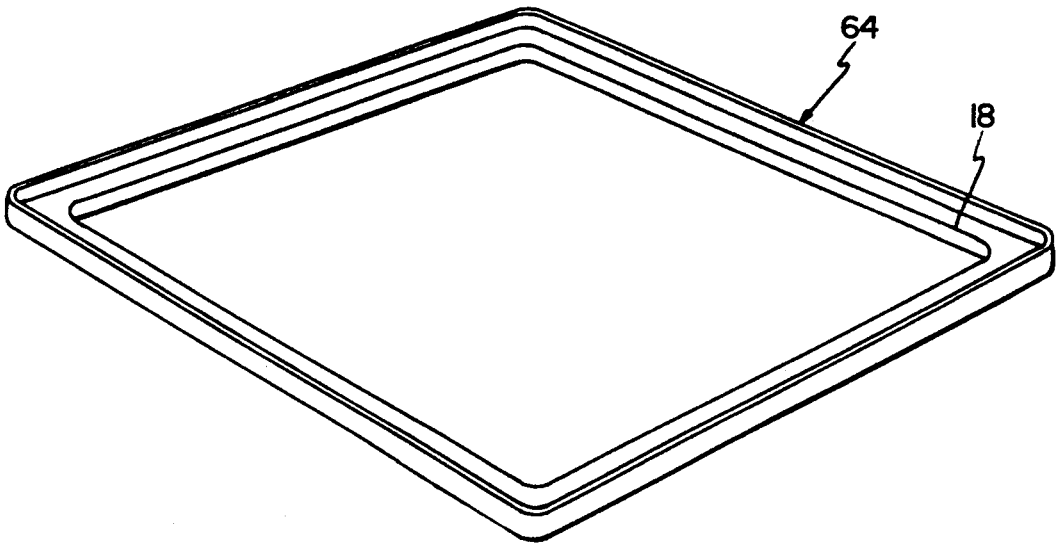
FIG. 14 shows a retaining frame of the joint. framework according to the invention.
Figure 15:
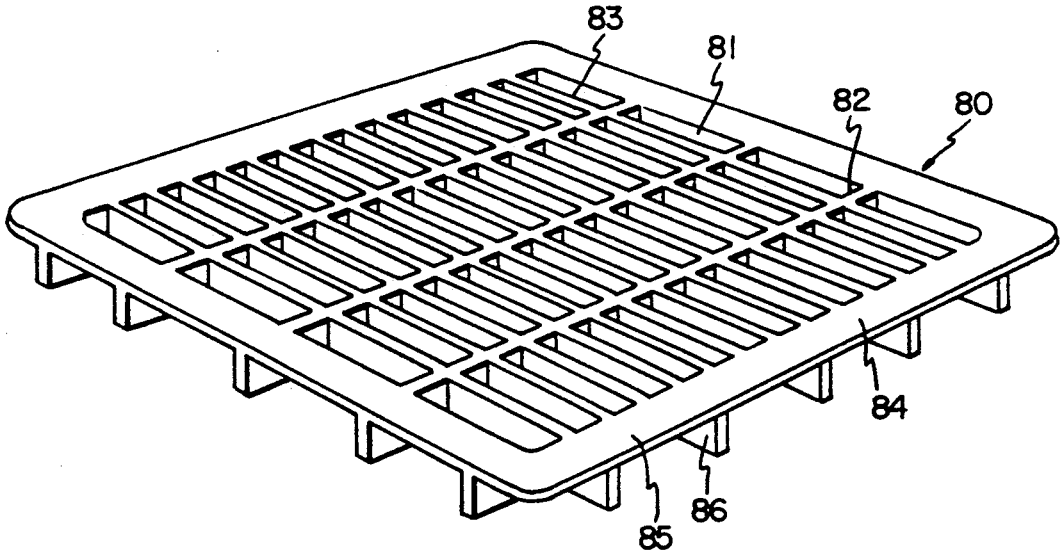
FIG. 15 shows an insert which makes a vent possible in the glass building unit.

In the representation of FIG. 14, a retaining unit (64), in the form denoted for example in conjunction with FIGS. 4A and 4B, serves to receive a grille (80) through the openings (81) of which venting can take place. The openings are bounded by mutually perpendicular ribs (82, 83). These form one-sided projections of a plate (84) with a peripheral uninterrupted flange (85) and downwardly projecting feet (86), which are supported on the ledge (18) of the retainer.

Figure 12:
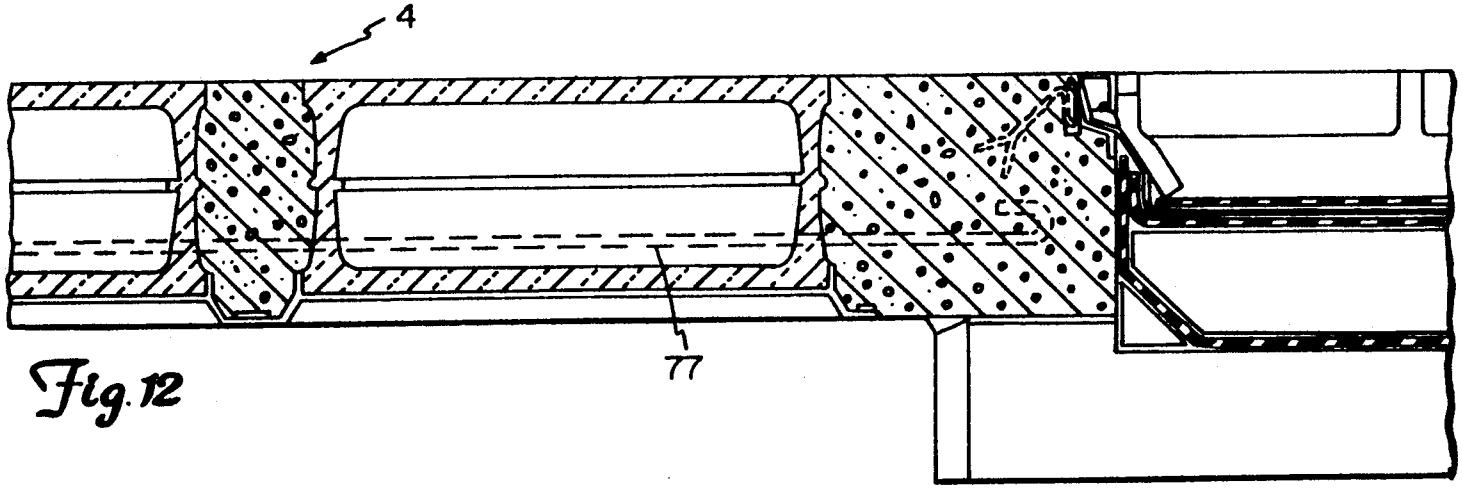
FIG. 12 shows a glass building unit according to the invention in use of the joint framework according to FIGS. 8 and 9, in partial cross-section.
Figure 13:
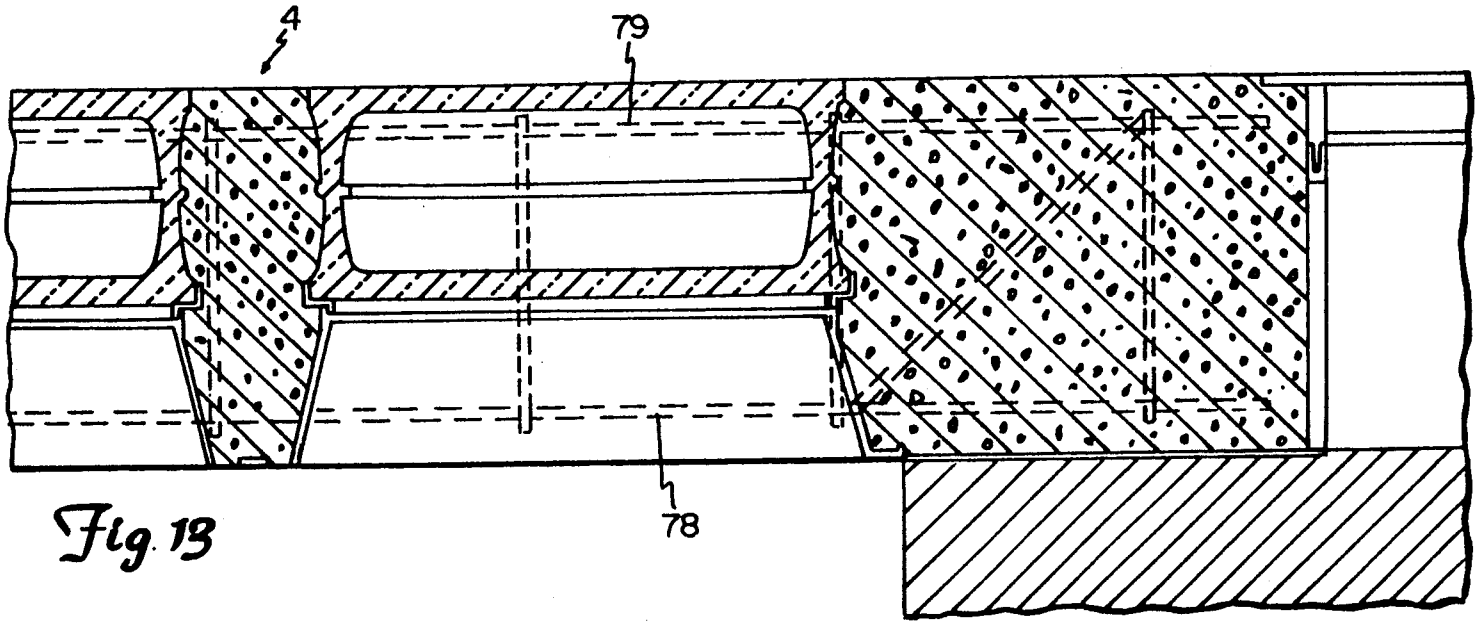
FIG. 13 shows a glass building unit according to the invention in use of a joint framework according to FIGS. 4A and 4B.

As otherwise represented in FIGS. 12 and 13, the joints (4–9) are filled with mortar or concrete. The positive interlock by the described tongues and strips is so resistant that mortar or concrete can be compacted by vibration without the formwork losing its unity.

Although the present invention has been described with reference to preferred embodiments, workers skilled in the art will recognize that changes may be made in form and detail without departing from the spirit and scope of the invention.

What is claimed is:

1. An outer frame for a joint framework for a building unit comprising:

a retainer for supporting a unit, the retainer including a peripheral ledge upon which the unit is supported; and a multi-planar support base having a first peripheral surface integral with the retainer and a second peripheral surface some distance therefrom, the distance between the first and second peripheral surfaces defining the extent of the base, the second peripheral surface including a ledge extending outwardly therefrom, the ledge including projecting tongues extending in the same plane as the ledge and having grooves, the ledge including edge sections, the edge sections coupling with the grooves of the projecting tongues of an adjacent outer frame for connecting consecutive outer frames to form a joint framework having joints for receiving an adhesive mixture therein to form the building unit, the cooperation of the bases and ledges of consecutive connected frames defining the joints of the joint framework wherein the grooves of the projecting tongues of a first frame and the edge sections of a second adjacent frame lock together for joining consecutive frames.

2. The outer frame of claim 1 wherein the edge sections are formed by longitudinal edge strips mounted along the ledge of the base.

3. The outer frame of claim 1 wherein the base includes sloped sides connected to form a truncated pyramid shaped base.

4. The outer frame of claim 1 wherein the retainer further includes an outer rib for positively fixing a unit supported thereby.

5. The outer frame of claim 1 and further including at least one extension frame interposed between the retainer and the base for increasing joint depth.

6. The outer frame of claim 5 wherein the extension frame includes four connected sides.

7. The outer frame of claim 1 wherein ledges of bases of consecutive outer frames abut against each other when the grooves of the tongues engage the edge sections of an adjacent outer frame.

8. An outer frame for a joint framework for a building unit comprising:

a retainer for supporting a unit, the retainer including a peripheral ledge upon which the unit is supported; and a multi-planar support base having a first peripheral surface integral with the retainer and a second peripheral surface some distance therefrom, the distance between the first and second peripheral surfaces defining the extent of the base, the second peripheral surface including a ledge extending outwardly therefrom, the ledge including projecting tongues extending in the plane of the ledge and the ledge including edge sections, consecutive outer frames being connected to form a joint framework having joints for receiving an adhesive mixture therein to form the building unit, the cooperation of the bases and ledges of consecutive frames defining the joints of the joint framework, the projecting tongues extending from the ledge including at least one projecting tongue including a groove and at least one projecting smooth tongue, the projecting tongues having a groove being designed to cooperate with an edge section of an adjacent outer frame.

9. The outer frame of claim 8 wherein the edge sections are formed by longitudinal edge strips mounted along the ledge of the base, the longitudinal edge strips including recesses designed to cooperate with the smooth tongues of consecutive outer frames.

10. An outer frame for a joint framework for a building unit comprising:

a "Z" shaped profiled retainer for supporting a unit, the retainer including an inner flange, a supporting surface and an outer rib, the outer rib designed to enclose and fix a unit; and a multi-planar support base having a first peripheral surface for supporting the "Z" shaped retainer where the inner flange secures the "Z" shaped retainer relative to the support base and a second peripheral surface some distance therefrom, the distance between the first and second peripheral surfaces defining the extent of the base, the second peripheral surface including a ledge extending outwardly therefrom, the ledge including projecting tongues extending in the same plane as the ledge having grooves, the ledge including edge sections, the edge sections coupling with the grooves of the projecting tongues of an adjacent outer frame for connecting consecutive outer frames to form a joint framework having joints for receiving an adhesive mixture therein to form the building unit, the cooperation of the bases and ledges of consecutive frames defining the joints between consecutive frames for the joint framework wherein the grooves of the projecting tongues of a first frame and edge sections of a second adjacent frame lock together for joining consecutive frames.

11. The outer frame of claim 10 and further including at least one extension frame interposed between the retainer and the base for increasing joint depth.

* * * * *

UNITED STATES PATENT AND TRADEMARK OFFICE

CERTIFICATE OF CORRECTION

PATENT NO. : 5,297,371

DATED : March 29, 1994

INVENTOR(S) : ODDO BORGHETTO

It is certified that error appears in the above-identified patent and that said Letters Patent is hereby corrected as shown below:

Col. 1, line 29, before "structures", insert --load-bearing--

Col. 1, line 68, after "dimensions", insert --perpendicularly--

Col. 4, line 9, after "joint", delete the "."

Col. 4, line 23, after "(100)", delete the ","

Col. 4, line 32, delete "an", insert --a--

Col. 4, line 49, delete "18B", insert --16B--

Col. 4, line 53, delete "embodiments", insert --embodiment--

Signed and Sealed this

Twenty-third Day of August, 1994

*Attest:*

Bruce Lehman

BRUCE LEHMAN

*Attesting Officer*

*Commissioner of Patents and Trademarks*